US005755823A

United States Patent [19]

Cleary

[11] Patent Number: 5,755,823

[45] Date of Patent: May 26, 1998

[54] COLLAPSIBLE FRAME FOR WEIGHT LIFTERS

[76] Inventor: Sean Cleary, 1333 Selo Dr., Sunnyvale, Calif. 94087

[21] Appl. No.: 717,457

[22] Filed: Sep. 20, 1996

[51] Int. Cl.[6] ..... A63B 21/078

[52] U.S. Cl. ..... 482/104

[58] Field of Search ..... 482/93, 94, 98, 482/99, 104

[56] References Cited

U.S. PATENT DOCUMENTS 4,306,715 12/1981 Sutherland ..... 482/104
5,433,607 7/1995 Hinzman et al. ..... 482/104

*Primary Examiner*—Richard J. Apley

*Assistant Examiner*—John Mulcahy

[57] ABSTRACT

A collapsible frame for weight lifters, comprising a rear pair of vertical support members, a front pair of vertical support members, each vertical support member having an upper and lower end, a rear removable horizontal support member rigidly secured between the rear pair of vertical support members, a pair of adjustable side horizontal support members, each of the adjustable side horizontal support members in selectably rigid securement with one member of the rear pair of vertical support members and one member of the front pair of vertical support members directing the vertical support members at a forward and inward angle, a safety zone defined by the rear vertical support members and the rear and side adjustable horizontal support members, and angled pegs at the upper ends of the long pair of vertical support members to safely support a weight bar. The center of gravity of the frame is always within the safety zone.

20 Claims, 3 Drawing Sheets

COLLAPSIBLE FRAME FOR WEIGHT LIFTERS

BACKGROUND OF THE INVENTION

1. Field of the Invention

The present invention is a collapsible frame for weight lifters. Weight lifting has become a popular recreational activity for a large number of people. In the past, most people have had to go to a gym or other facility where, for a fee, the strong equipment necessary to hold the weight bar in a ready position could be used. Also, in order to exercise all muscle groups, different pieces of equipment were needed for different exercises. The cost of all necessary weight lifting equipment was prohibitive for an individual for home use.

More particularly, the present invention relates to weight lifting frames which are portable and, thus, suited for use in situations where exercise space is limited, or a permanent weight lifting rack is not available, such as in home environs. Further, the present invention teaches a portable and collapsible weight frame which can be disassembled into easily storable metal components.

2. Description of the Related Art

Prior art home equipment for weight lifters has two major disadvantages. First, in order to minimize space requirements and weight, home systems often compromised the range of muscle groups that could be exercised, making a compact, but incomplete system. Further, prior art home systems tended to be lighter in weight and thus less stable than gym equipment, with the risk that the frame will tip over when a heavy weight is held on the frame several feet from the floor with a high center of gravity. The risk of injury to the weight lifter was substantial.

Second, even the compact systems required the dedication of an entire room in the home for weight-lifting, often by only one member of the family. The weight lifters frame could not be put in a closet, for example, when not in use. An example of a home system requiring a dedicated room are U.S. Pat. Nos. 5,082,260 to Dinelli, 4,527,797 to Slade, Jr., et al. and 4,306,715 to Sutherland which typify the prior art and demonstrate the above characteristics. These frames are not portable, and they are bulky and require time-consuming adjustment. There is a need for a low-cost, collapsible, yet strong frame for weight lifters that will allow the full range of exercise for all muscle groups.

There are several collapsible weight lifting frames known in the art. These prior art weight frames also normally require another person to assist the weight-lifter using the weight frame for safe operation. Because of the requirements for space, lack of portability, expense, and need for assistance in usage, weight frames are generally unavailable to the average individual for personal use in the home environment.

There are several portable and collapsible weight frames known in the art which allow a user to safely preform weight-lifting exercises alone, however, they typically are expensive, complicated to use, and do not fully collapse for purposes of storage. Also, these prior art frames often sacrifice strength and safety for collapsible capability.

A portable and collapsible weight-lifting frame reflective of the art is U.S. Pat. No. 5,306,220 to Kearney. The Kearney patent teaches a Knock-Down Weight-Lifting Frame and Exercise System. The weight-lifting frame aspect of the Kearney patent teaches a pair of vertically adjustable member which slidably fit within other rigidly connected vertical members. The rigidly connected vertical members are in turn adjustably rigidly connected to each other at their forward portions.

The Kearney patent does not teach a weight frame which is collapsible into metal channels. Also, the Kearney patent has vertical extensions from other fixed vertical members to support the weight bar, can be unsafe in usage. The cradle for the weight bar is very narrow and a person attempting to lower a weight bar onto the cradle may miss the cradle entirely. Furthermore, the vertical extension can be very unstable. Regardless of the method used to secure it into the other vertical member, at full extension, a heavy weight can cause stress at the extension point such that the vertical extension may bend or collapse, injuring the user.

The present invention does not have these problem as it is made from single units, all in rigid assembly with essentially zero tolerance. Furthermore, the present invention has its vertical components angled such that extreme weights, and thus, forces, may be applied to the frame without distressing the frame, or affecting stability of the weight frame. None of the prior art known to the inventor teaches the advantages of slightly angling the vertical components inward and forward to achieve a stronger and more rigid frame.

None of the collapsible weight-lifting frames known to the inventor address the problems solved by the present invention, that is, providing a frame for weight lifters that is portable and partially collapsible, simple to use, safe to use alone, and which can withstand usage of very heavy weights without distressing or destabilizing the frame.

SUMMARY OF THE INVENTION

The primary object of the present invention is to provide a collapsible frame for weight-lifters comprised of metal components.

It is another object of the present invention to provide a collapsible frame for weight lifters which is safe to be used alone while weight-lifting.

It is a further object of the present invention to provide a collapsible weight lifting system which allows a user to safely perform a variety of weight-lifting exercises to maximize exercise efficiency, while minimizing the harm to the weight lifter by dropping the weights.

It is yet another object of the present invention to provide a weight frame having a safety zone within its interior defined by the angled rear vertical support members, the rear horizontal support member and the adjustable side support members, into which the weight bar or individual weights will not fall.

It is a further object of the present invention to provide a collapsible frame for weight lifters which can safely hold the maximum weight possible on a weight bar, without causing distress to the frame members, and without causing the destabilization of the frame, allowing it to tip over or buckle.

It is yet a further object of the present invention to provide a collapsible frame for weight lifters which weighs 35 kg, yet can hold a static load in excess of 500 kg.

It is yet another object of the present invention to provide a collapsible frame for weight lifters, the vertical members of which are angled such that heavy weight does not cause the frame to tip over.

It is yet a further object of the present invention to provide a collapsible frame for weight lifters which is connected by removable bolts and peg-in-hole fittings such that the frame can be assembled easily without complication.

It is yet another object of the present invention to provide a collapsible weight-lifting frame which has simple means for safely holding a weight bar level at the upper end of the vertical support members.

It is yet a further object of the present invention to provide a collapsible weight-lifting frame which is made from simple steel alloy channels for economical manufacture and durable usage.

It is yet another object of the present invention to provide a collapsible weight-lifting frame which can be used with existing weight bars and weight benches.

It is yet a further object of the present invention to provide a collapsible weight-lifting frame which can rest on any level surface sufficient to support the weight of the frame and weights.

The present invention provides a collapsible frame for weight lifters, comprising a long pair of vertical support members, each vertical support member having an upper and lower end, a short pair of vertical support members, each vertical support member having an upper and lower end, a rear removable horizontal support member rigidly secured between the long pair of vertical support members, a front removable horizontal support member rigidly secured between the short pair of vertical support members, a pair of adjustable side support members, each of the adjustable side support members in selectably rigid securement with one member of the long pair of vertical support members and one member of the short pair of vertical support members, direct the long vertical support member at an angle towards the short vertical support member, a safety zone in the interior of the frame, defined by the rear vertical support members and the rear and adjustable side horizontal support members, and means at the upper ends of the long pair of vertical support members to safely support a weight bar. Whereby, the center of gravity of the weighted frame is always within the safety zone.

The above and yet further objects and advantages will become apparent from the hereinafter set forth Brief Description of the Drawings, Detailed Description of the Invention, and claims appended herewith.

DETAILED DESCRIPTION OF THE INVENTION

Figure 1:
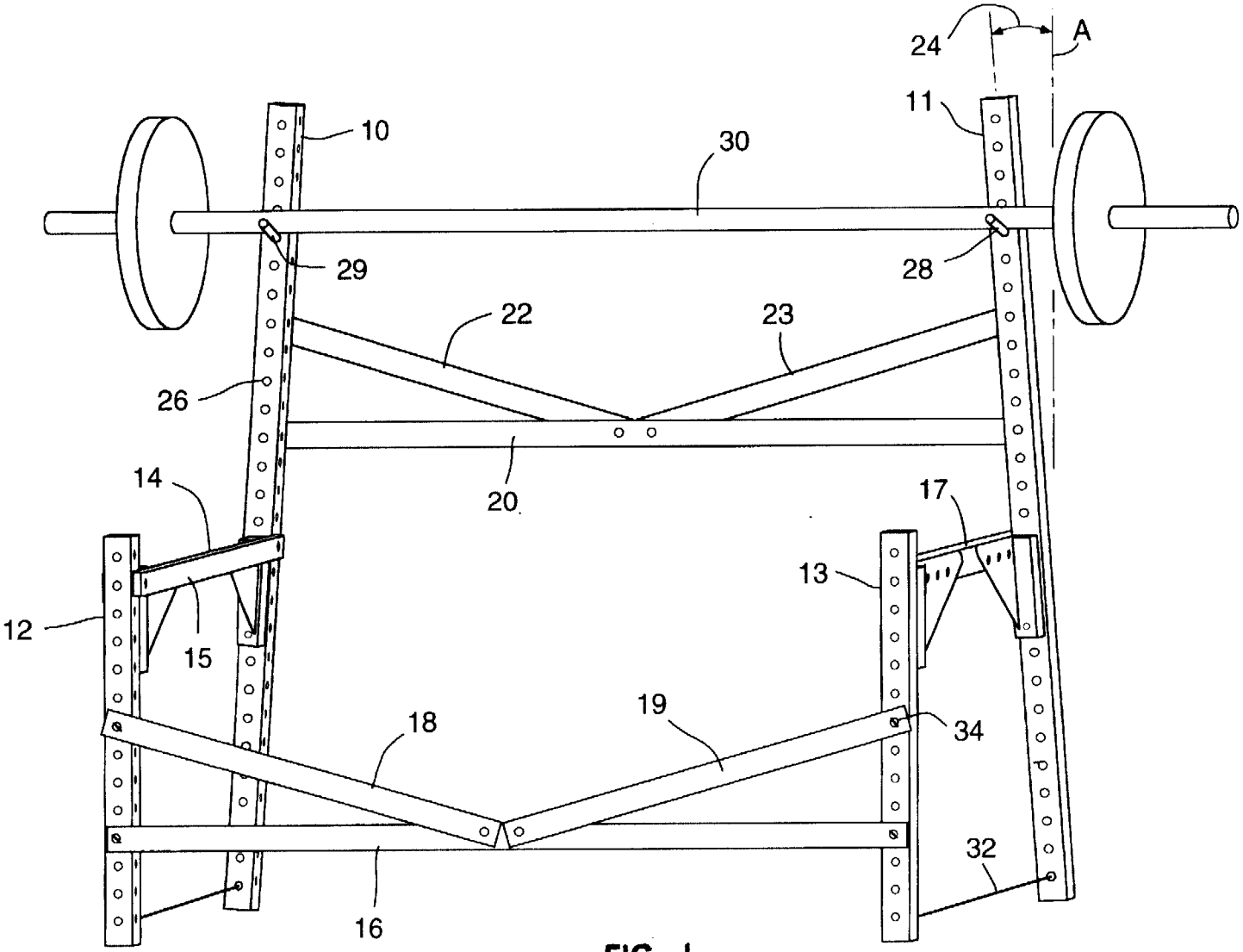
FIG. 1 is a perspective view of the present invention.

The present invention is a collapsible weight-lifting frame, as shown in FIG. 1, designed to disassemble into metal rods, yet, assemble into a weight-lifting frame weighing only 35 kg, yet having sufficient strength to support a static load of weights in excess of 500 kg. More particularly, as seen in FIG. 1, the portable frame is comprised of a rear pair of vertical support members 10 and 11, and front pair of vertical support members 12 and 13. The front pair of vertical support members 12 and 13 are embodied as shown being substantially shorter than the rear pair of vertical support members 10 and 11. This gives the user the advantage of easily placing the weight bar 30 onto the weight bar holding means 28 and 29 at the upper ends of the rear pair of vertical support members 10 and 11 from the front, without having to lift the bar itself over the rear support members. For most weight lifters, the satisfactory lengths of the rear pair of vertical support members 10 and 11 should be 6 feet, and the front pair of vertical support members 12 and 13 should be about 4 feet.

The pair of rear vertical support members 10 and 11 and front pair of vertical support members 12 and 13 are steel channels, square in shape, approximately 2 inches by 2 inches in dimension. To allow for adjustment, members 10, 11, 12 and 13 have spaced holes 26 drilled throughout their lengths approximately 2 to 3 inches apart. The holes 26 allow for the removable and adjustable attachment of the side support members 14 and 17, without comprising rigidity or strength.

While any configuration may be used to support weights up to 500 kg, I prefer to use rolled steel, bent and welded to form hollow channels for the support members. For vertical members 10, 11, 12 and 13, I prefer 2 inch square cross-section channels. For horizontal support members, I prefer 2 inch by 1 inch hollow channels, without holes drilled throughout their lengths.

Channels of different shapes, such as round or hexagonal cross-section may be used as well. Of course, aluminum or magnesium may be used for lighter weight, but I have found steel to be most cost effective. Titanium has greater tensile strength and would create and even stronger frame, however, the cost of manufacture may offset the strength advantage. Even with steel, the frame is very light, about 35 kg, yet will be able to support about 15 times its own weight in static load.

Several frames in the prior art teach the use of feet on vertical support members for added stabilization. The present invention does not need feet as it is adequately stable as discussed herein. Furthermore, the use of feet may be injurious to the user may trip of ver the feet while using the frame, and the feet also may detract from the stabilization created by the angling of the vertical members discussed herein. Accordingly, while the present invention may be embodies with feet at the bottoms of the vertical support members, it is not recommended.

The frame also has a rear horizontal support member 20 which laterally braces the rear pair of vertical support members 10 and 11. In FIG. 1, the rear horizontal support member 20 has angular supports 22 and 23 additionally attaching the rear horizontal support 20 and to the rear pair of vertical supports 10 and 11. This allows for increased lateral strength, and also allows the rear pair of vertical supports 10 and 11 to be slightly angled towards each other. The angle 24 is in a range from 2 to 6 degrees from a plumbline A towards the other member of the rear pair of vertical support members 10, with 4 degrees being optimum.

When the rear horizontal support member 20 is lower than the weight bar holding means 28, it adds to the structural stability of the frame as the slight angle causes the weight bar 30 to be supported by the triangular structure defined by the rear vertical support member, the rear horizontal support member and the angular support. The triangular structure can support more weight safely, instead of solely the rear vertical support members.

However, the rear horizontal support member 20 may be placed at the upper end of the rear vertical support members 10 and 11. This placement is recommended if the frame does not use a front horizonal support member 16 as having the rear horizontal support member 20 at the upper ends of the vertical support members 10 and 11 greatly increases the rigidity of the rear vertical support members 10 and 11 to compensate for the lack of the front horizontal support member 16.

Figure 4:
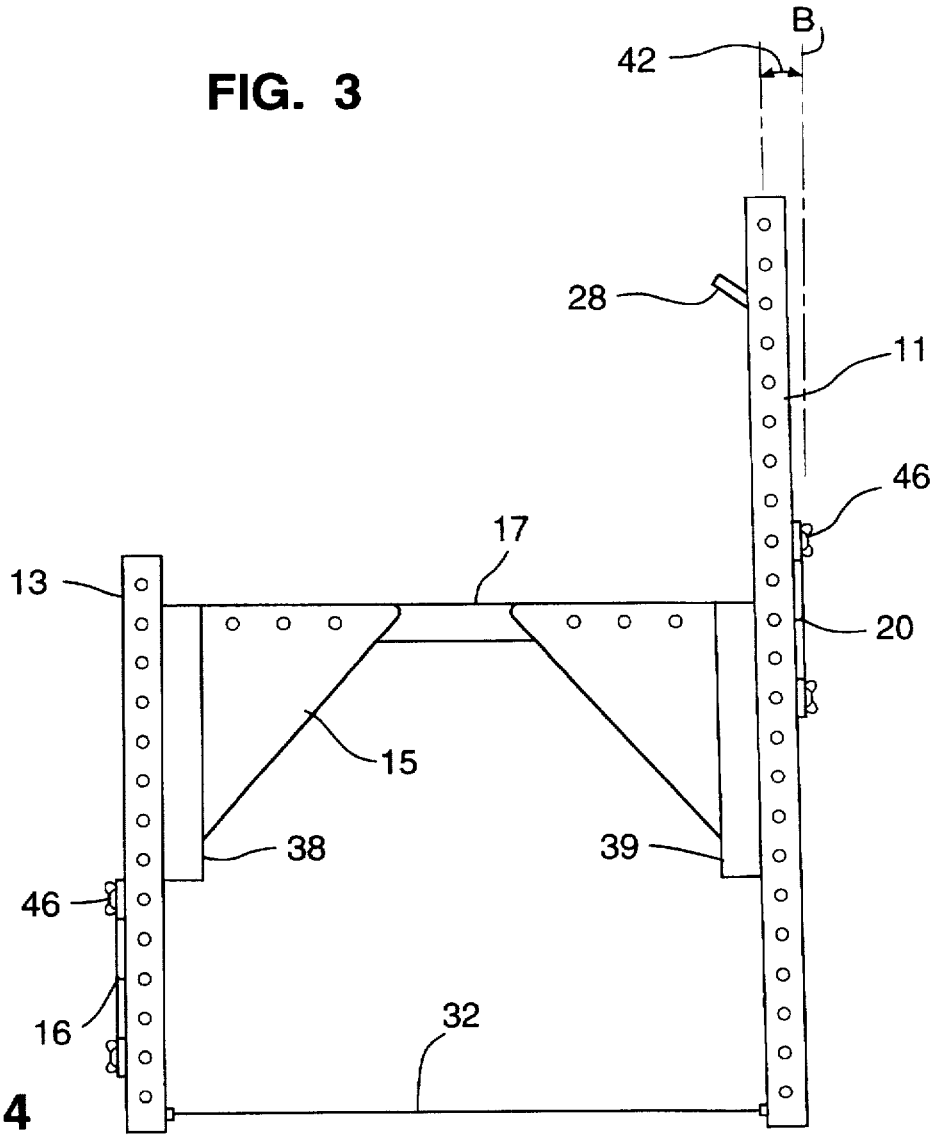
FIG. 4 is a side view of the present invention.

As shown in FIG. 4. The rear horizontal support member 20 is rigidly affixed to the rear pair of vertical support members 10 and 11 though the use of bolts, either slotted-head bolts 34, or through the use of wing-nut bolts 46 in FIG. 4. While bolts are the preferred embodiment, any means which could selectively attach the horizontal support members may be used.

As shown in FIG. 1, the frame is also has a front horizontal support member 16 with angular supports 18 and 19 attached to the front pair of vertical support members 12 and 13. A front horizontal support member adds to the structural rigidity of the frame, although, the frame may be embodied without a front horizontal support member.

The front horizontal support member 16 is substantially similar to the rear horizontal support member in construct, method of attachment and function, except that it should be attached to the front pair of vertical support members 12 and 13 at a point sufficiently low to allow the user to step over it to easily enter the frame. Also, a typical weight bench may be placed over the front horizontal 16 support member so that a user can perform exercises using the bench within the frame, thereby having the safety benefits of the frame as the pair of adjustable side horizontal support members 14 and 17 prevent any dropped weight from injuring the user or falling to the floor.

The rear and front horizontal support members 20 and 16 should be between 4 and 6 feet in length, however, their length is to be governed by the length of weight bars to be rested upon the frame. It is recommended that rear vertical support members 10 and 11 be 6 feet in length and the front vertical support members 12 and 13 be 4 feet in length.

Figure 3:
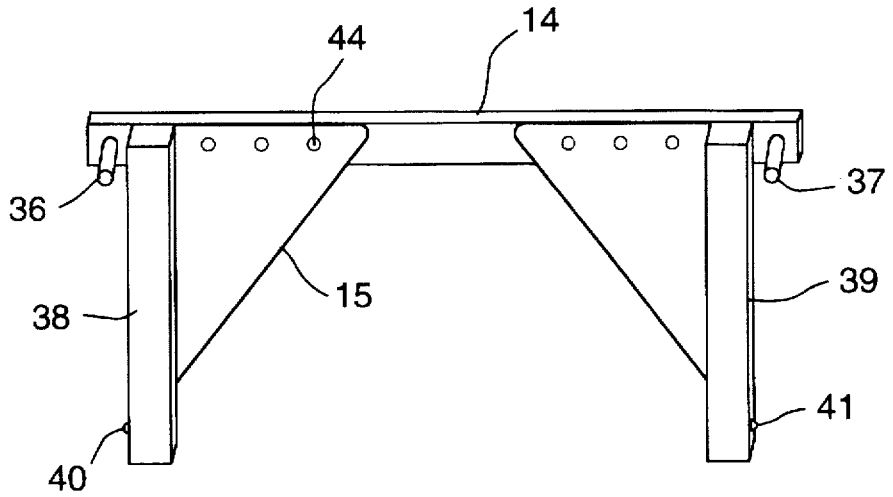
FIG. 3 is a side view of the adjustable side support member.

The adjustable side horizontal support members 14 and 17, as seen in FIG. 3, have a pair of legs 38 and 39. The legs 38 and 39 are rigidly affixed to the side support member 14 by means of a plate 15. Pegs 36 and 37 on side insert into the evenly spaced holes on the vertical support members. The legs 38 and 39 have spring detents 40 and 41 which engage the desired holes on the front and rear vertical support members 12 and 10. The plates 15 are rigidly bolted 44 to the adjustable side horizontal support member 14 and add greater strength to the support by increasing load bearing strength. This spreads the force over a length of the vertical support member rather than on the pegs 36 and 37.

The adjustable side horizontal support members 14 and 17 are preferably between 2 to 4 feet in length, although, the length is to be governed by desired exercise regimen and storage characteristics.

Figure 2:
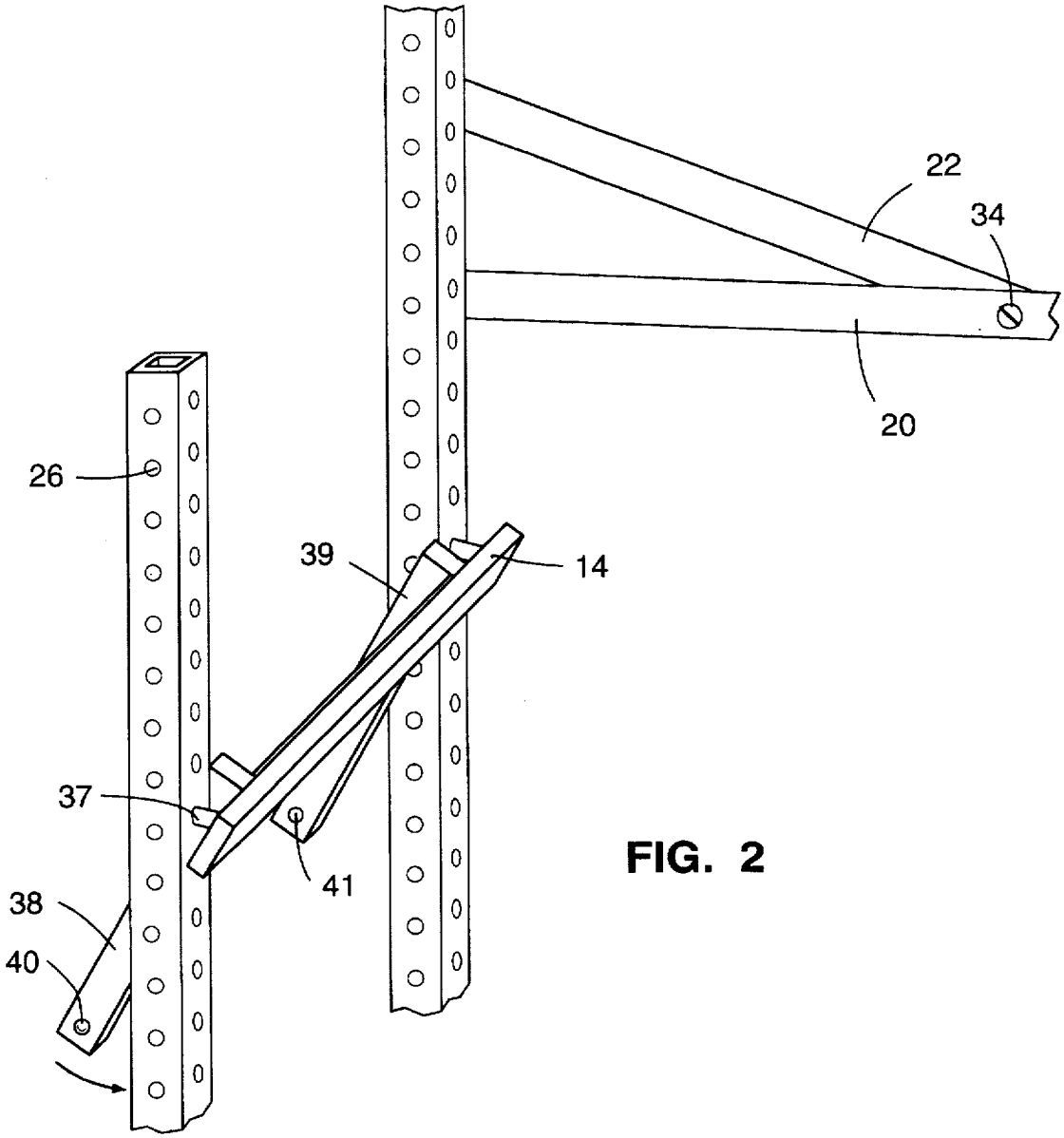
FIG. 2 is a perspective view of as adjustable side support member being rigidly secured into one each of the long and short pair of vertical support members.

As seen in FIG. 2, in operation, pegs 36 and 37 of the adjustable side horizontal support member 14 slide into the evenly spaced holes of rear vertical support member 10 and front vertical support members 12, causing the legs 38 and 39 to slide into contact with the each of the vertical support members such that the spring detents 40 and 41 engage the evenly spaced holes, securing the adjustable side horizontal support member.

The pegs 36 and 37 are angled downwardly in a range between 20 and 30 degrees, with 24 degrees being optimal. At 24 degrees, pegs 36 and 37 to hold the adjustable side horizontal support member 14 in zero tolerance with the front and rear vertical support members 10 and 12. This rigidity is enhances with the extra resistance created by the legs 38 and 39 and the engagement of the spring detents 40 and 41.

Further, the adjustable side horizontal support members 14 hold the rear pair of vertical support members 10 and 11 and front vertical support members 12 and 13 at angle towards the front, as shown in FIG. 4. The angle 42 is measured in a range between 1 and 10 degrees from a plumbline B to front vertical support member 13. It is recommended that the pair of adjustable side horizontal support members 14 give the front pair of vertical support members 12 and 13 a forward angle, parallel to angle 42. Angle 42 allows the center of gravity to shift towards the center of the frame, giving greater structural rigidity. This prevents the frame from being tipped over when weights are placed at the upper end of the rear pair of vertical support members 10 and 11.

The rear vertical support members 10 and 11 could have a bend through their middle towards the interior of the frame to achieve the same shifting of the center of gravity. However, such a bend causes the vertical support member to lose some of its structural integrity and therefore, it is not recommended to use such a bend. With the slight angling of the vertical support member as disclosed, the objects of the invention are achieved while minimizing the risk of destabilization due to any bending in the vertical support members.

When constructed with the inward angle 24, the center of gravity of the frame is shifted towards the center of the frame, creating a safety zone. The safety zone is defined between the adjustable side horizontal support members 14 and 17, and rear horizontal support member 20. The safety zone is further defined by the front horizontal support member 16 when present, thus, completely enclosing the safety zone to the interior of the frame. The safety zone enjoys the benefit that any weight bar dropped will either deflect on the angled rear vertical support members 10 and 11 or fall across the adjustable side horizontal support members 14 and 17. Further, any weight which may fall from the weight bar will fall outside of the frame.

The portable frame for weight lifters may also have a wire 32 attached to the lower ends of one member of the rear pair of vertical support members and front vertical support members, as seen in FIGS. 1 and 4. The wire 32 prevents the vertical support members from slipping away from each other and possibly causing the detents in the adjustable side horizontal support members 14 and 17 to dislodge from the vertical support members. If embodied with the forward angle 42, then the wire 32, or comparable means, should be used to insure the safety of the frame as their is a greater risk of such slippage.

The means for safely holding a weight bar is embodied here as being angled pegs 28 and 29 inserted through the holes at the upper end of the long pair of vertical support members 10, as seen in FIGS. 1 and 4. Alternatively, one may use hooks or any other means which allows the weight bar 30 to be inserted into the members 10 and 11, such that the bar 36 will not roll out and fall.

While there has been shown the preferred and alternate embodiments of the present invention, it is to be understood that the invention may be embodied otherwise that is herein specifically shown and described, and that within said embodiments, certain changes may be made in the form an arrangements of the parts without departing from the underlying ideas or principles of this invention as set forth in the claims appended herewith.

I claim:

1. A collapsible frame for weight lifters, comprising:

a rear pair of vertical support members, each rear support member having an upper and lower end;

a front pair of vertical support members, each front support member having an upper and lower end;

a rear horizontal support member removably and rigidly secured between said rear pair of vertical support members, directing said rear vertical support members at an angle toward each other;

a pair of adjustable side horizontal support members, each of said adjustable horizontal support members in selectable rigid securement along the lengths of one member of said rear pair of vertical support members and one member of said front pair of vertical support members directing both rear vertical support members at a forward angle;

a safety zone in the interior of the frame, defined by said rear vertical support members and said rear and adjustable side horizontal support members; and means at said upper ends of said rear pair of vertical support members to safely support a weight bar, whereby the center of gravity of the weighted frame is always within said safety zone.

2. The collapsible frame for weight lifters as recited in claim 1, wherein said angle of direction of said rear pair of vertical support members towards each other is between 2 and 6 degrees.

3. The collapsible frame for weight lifters as recited in claim 2, further comprising a pair of wires secured to said lower ends of said rear pair of vertical support members and attached to said lower ends of said front pair of vertical support members, thereby preventing movement of said lower ends of said front pair of vertical support members away from said lower ends of said rear pair of vertical support members.

4. The collapsible frame for weight lifters as recited in claim 1, wherein said rear pair and said front pair of vertical support members are metal channels having evenly spaced holes drilled throughout their lengths.

5. The collapsible frame for weight lifters as recited in claim 4, wherein said rear horizontal support member is selectably secured to said rear vertical support members through said holes.

6. The collapsible frame for weight lifters as recited in claim 5, wherein said pair of adjustable side horizontal support members further comprises:

an inner surface which faces said rear pair and said front pair of vertical support members, and further having inner and outer portions;

a pair of legs, each of said legs on said inner surface at said outer portions, said legs having a spring detent which slidably secures into said holes of said rear pair and said front pair of vertical support members; and a pair of pegs, each peg respectively rigidly secured to said inner surface at said outer portion of said adjustable horizontal support member distal to said legs, each peg downwardly angled.

7. The collapsible frame for weight lifters as recited in claim 6, wherein said downward angle of said pegs is between 20 and 30 degrees.

8. The collapsible frame for weight lifters as recited in claim 6, wherein said downward angle of said pegs is 24 degrees.

9. The collapsible frame for weight lifters as recited in claim 7, wherein said means for safely supporting a weight bar is a pair of pegs inserted at an upward angle in said holes at said upper ends of said rear pair of vertical support members.

10. A collapsible frame for weight lifters, comprising:

a rear pair of vertical support members, each rear support member having an upper and lower end;

a front pair of vertical support members, each front support member having an upper and lower end;

a rear horizontal support member removably and rigidly secured between said rear pair of vertical support members, directing said rear pair of vertical support members at an angle towards each other;

a front horizontal support member removably and rigidly secured between said front pair of vertical support members, directing said front pair of vertical support members at an angle towards each other;

a pair of adjustable side horizontal support members, each of said adjustable side horizontal support members in selectably rigid securement along the length of one member of said rear pair of vertical support members and one member of said front pair of vertical support members, directing said rear vertical support members at a forward angle;

a safety zone in the interior of the frame, defined by said rear vertical support members, and said rear horizontal support member, said adjustable side horizontal support members, and said front horizontal support member; and means at said upper ends of said rear pair of vertical support members to safely support a weight bar, whereby the center of gravity of the frame is always within said safety zone.

11. The collapsible frame for weight lifters as recited in claim 10, wherein said angle of direction of said rear pair of vertical support members towards each other is between 2 and 6 degrees.

12. The collapsible frame for weight lifters as recited in claim 11, wherein said angle of direction of said front pair of vertical support members towards each other is between 2 and 6 degrees.

13. The collapsible frame for weight lifters as recited in claim 12, wherein said forward angle of direction of said vertical support members is between 1 and 10 degrees.

14. The collapsible frame for weight lifters as recited in claim 13, further comprising a pair of wires secured to said lower ends of said rear pair of vertical support members, said wires selectably attaching to said lower ends of said front pair of vertical support members, thereby preventing movement of said lower ends of said front pair of vertical support members away from said lower ends of said rear pair of vertical support members.

15. The collapsible frame for weight lifters as recited in claim 14, wherein said rear pair and said front pair of vertical support members are metal channels having evenly spaced holes throughout their lengths.

16. The collapsible frame for weight lifters as recited in claim 15, wherein said front and rear horizontal support members are selectably secured to said vertical support members through said holes.

17. The collapsible frame for weight lifters as recited in claim 15, wherein said pair of adjustable side horizontal support members further comprise:

an inner surface which faces said rear pair and said front pair of said vertical support members, and inner and outer portions;

a pair of legs, each of said legs rigidly attached at said inner surface at said outer portions, said legs having spring detents which slidably secures into said holes of said long pair and said short pair of vertical support members; and a pair of pegs, each peg respectively rigidly secured to said inner surface at said outer portion of said adjustable side horizontal support member distal to said downward extensions, each peg downwardly angled.

18. The collapsible frame for weight lifters as recited in claim 17, wherein said downward angle of said pegs is between 20 and 30 degrees.

19. The collapsible frame for weight lifters as recited in claim 17, wherein said downward angle of said pegs is 24 degrees.

20. The collapsible frame for weight lifters as recited in claim 19, wherein said means for safely support a weight bar is a pair of pegs inserted at an upward angle in said holes at said upper ends of said rear pair of vertical support members.

* * * * *